US005590681A

United States Patent [19]

Schaefer et al.

[11] Patent Number: 5,590,681

[45] Date of Patent: Jan. 7, 1997

[54] VALVE ASSEMBLY

[75] Inventors: Richard L. Schaefer; Carl W. D. Schaefer; James M. Williamson, all of Dayton; Norman L. Miller, Huber Heights, all of Ohio

[73] Assignee: Frank W. Schaefer, Inc., Dayton, Ohio

[21] Appl. No.: 263,240

[22] Filed: Jun. 28, 1994

Related U.S. Application Data

[63] Continuation-in-part of Ser. No. 86,882, Jul. 2, 1993, abandoned.

[51] Int. Cl.[6] ..... F16L 7/00

[52] U.S. Cl. ..... 137/375; 137/315; 251/368

[58] Field of Search ..... 251/368; 137/375, 137/315

[56] References Cited

U.S. PATENT DOCUMENTS

| | | | |
|---|---|---|---|
| Re. 27,945 | 3/1974 | Hunt et al. . | |
| 925,809 | 6/1909 | Henss | 137/375 |
| 1,981,825 | 11/1934 | Miller, Jr. | 137/375 |
| 2,352,799 | 7/1944 | Newton | 137/375 |
| 2,364,615 | 12/1944 | Beckes . | |
| 2,854,228 | 9/1958 | Franks et al. . | |
| 3,032,841 | 5/1962 | Sylvester . | |
| 3,044,489 | 7/1962 | Raub et al. | 137/375 |
| 3,552,478 | 1/1971 | Lavener . | |
| 3,554,268 | 1/1971 | Taylor et al. . | |

(List continued on next page.)

FOREIGN PATENT DOCUMENTS

| | | |
|---|---|---|
| 916860 | 12/1946 | France . |
| 876751 | 5/1953 | Germany . |
| 1151357 | 8/1956 | Germany . |
| 3923717 | 10/1964 | Japan . |
| 5103266 | 8/1980 | Japan . |
| 58-148069 | 9/1983 | Japan . |
| 8148069 | 9/1983 | Japan . |
| 6245463 | 2/1987 | Japan . |
| 62-45463 | 2/1987 | Japan . |
| 1001979 | 8/1965 | United Kingdom . |
| 1171295 | 11/1969 | United Kingdom . |
| 1439875 | 6/1976 | United Kingdom . |
| 2103132 | 2/1983 | United Kingdom . |

OTHER PUBLICATIONS

123 Enginering 185–188, vol. 23, Mar. 1981, No. 3, London, Gr. Britain.

PCT International Publiction No. WO80/00317, Published Mar. 6, 1980.

Brochure titled "Detrick Interstop" Published by M. H. Detrick Co., 1983.

Brochure titled "Furnace for Melting and Holding Aluminum" Published by Frank W. Schaefer Inc., 1992.

*Primary Examiner*—A. Michael Chambers

*Attorney, Agent, or Firm*—Roger S. Dybvig

[57] ABSTRACT

Molten metal is delivered from a master furnace to the molten metal holding chamber of a low pressure casting machine by a launder assembly having a unitary, quickly replaceable, valve assembly including a valve which, when closed, prevents flow of the molten metal from the master furnace to the holding vessel. The valve has a plug mounted for rotation in a valve body which may be made from graphite. In a modification, the valve has a port centered in a valve plate and a movable plug which may be made from aluminum titanate. In operation, the valve is opened to permit the molten metal within the master furnace and the holding vessel to seek a substantially uniform level and closed when the low pressure casting process is initiated. While the valve is closed, a pressurizing gas is introduced into the holding vessel above the level of the molten metal therein so that molten metal will rise up a riser tube into the cavity of a mold or other molten metal-receiving member. After the cavity is filled and before the next molding operation is begun, the pressurizing gas is exhausted so the pressure above the molten metal in the holding vessel is lowered to or near to atmospheric pressure and the valve opened so that the molten metal in the holding vessel and the master furnace again begins to seek a substantially uniform level. This process can be repeated indefinitely to produce plural molded parts.

37 Claims, 8 Drawing Sheets

U.S. PATENT DOCUMENTS

| | | | |
|---|---|---|---|
| 3,565,162 | 2/1971 | Farmer | 164/337 |
| 3,940,264 | 2/1976 | Seirvurin . | |
| 4,047,558 | 9/1977 | Kotthoff et al. . | |
| 4,053,012 | 10/1977 | Farmer . | |
| 4,143,687 | 3/1979 | Belloi . | |
| 4,153,100 | 5/1979 | Balevski et al. . | |
| 4,277,539 | 7/1991 | Keller et al. | 428/450 |
| 4,860,820 | 8/1989 | Pereira . | |
| 4,967,827 | 11/1990 | Campbell . | |
| 5,022,458 | 6/1991 | Smith | 164/457 |
| 5,085,356 | 2/1992 | Walterpühl . | |
| 5,092,500 | 3/1992 | Weber et al. . | |
| 5,303,764 | 4/1994 | Sasaki et al. . | |

10
14
16
18
40
42
44
46
48
50
52
54
56
58
60
62
64
66
66A
68
70
72
74
76
78
80
82
84
88
90
92
96
120
122
130
138
146
148
150
154
156
158
172
174
178
186
189
190
191
192
194
195
196
202
204
205
206
208
210
212
214
216
218
220
222
224
3
3

VALVE ASSEMBLY

CROSS-REFERENCE TO RELATED APPLICATION

This is a continuation-in-part of application Ser. No. 08/086,822, of Richard L. Schaefer et al., filed Jul. 2, 1993, now abandoned.

FIELD OF THE INVENTION

This invention relates to a low pressure casting process and apparatus, particularly for producing parts made from aluminum or aluminum alloys. (For convenience, the word "aluminum" is used in the following description and the claims to refer to aluminum and also to aluminum alloys.) Those familiar with metal casting processes will recognize that this invention can also be applied to methods and apparatus used for producing parts made from non-ferrous metals other than aluminum, such as zinc, bronze, brass and magnesium.

BACKGROUND OF THE INVENTION

A conventional low pressure casting machine comprises a holding furnace having a holding chamber substantially filled with molten metal and a vented mold or other molten metal-receiving member mounted on top of a pressure-tight furnace lid or cover. The mold or other molten metal-receiving member is mounted on a fixture that is in communication with a riser tube that extends through the furnace lid and into the molten bath. A gas under pressure is introduced into the holding furnace chamber above the molten metal bath whereupon the molten metal flows upwardly through the riser tube into the mold. Such machines are called "low pressure" casting machines because the pressure exerted on top of the metal bath within the holding furnace is only on the order of three to ten pounds per square inch above atmosphere.

Low pressure casting processes are essentially non-turbulent. Since molten aluminum which has been agitated, particularly in air, is less dense and of lower quality because of higher levels of oxide inclusions than metal which has not been agitated, parts produced by low pressure casting processes are often denser and of higher quality than parts produced by other casting operations.

Although there is minimal agitation of the aluminum during a low pressure casting operation, there is a problem encountered with known low pressure aluminum casting operations because there is no satisfactory way to deliver molten metal to the low pressure holding furnace which does not cause the molten metal to be exposed to air and agitated during the delivery process. To fill a low pressure holding furnace with molten metal, molten metal which has been transferred out of a metal melting furnace (or a holding furnace located adjacent the low pressure casting machine), is poured into the low pressure holding furnace by a transfer device, such as a ladle. To do this, it is usually first necessary to open a pressure-tight cover over the holding furnace, transfer the molten metal into the holding furnace, and replace the pressure-tight cover. During these operations, the metal is agitated by the transferring and pouring operations so that molten metal in the holding furnace may already be significantly agitated before the casting operations are begun. These are time-consuming and expensive operations which may produce parts having less than the desired quality.

In a typical aluminum die casting system, aluminum melted by a melting furnace is delivered to a holding furnace adjacent a die casting machine so that the metal used for die casting is ladled out of holding furnace. Improved quality of die-cast metal parts is obtained by delivering the molten metal to the holding furnace (or holding furnaces) by a launder assembly which relies on the property of liquids to maintain a uniform level. If an installation has one or more aluminum melting furnaces and one or more holding furnaces connected by a launder assembly, the level of the molten aluminum throughout the system remains substantially constant. When molten aluminum is removed from a holding furnace for a die casting operation, the level of the molten aluminum temporarily lowers but immediately begins to return to its normal level as the melting furnace replenishes the aluminum in the system. Some launder assemblies have fairly short launder troughs which need not be heated to maintain the aluminum in a molten state. In other cases, the launder troughs are so long that they are provided with spaced heating elements for maintaining the aluminum in a molten condition.

SUMMARY OF THE INVENTION

An object of this invention is to improve the quality of molded non-ferrous metal parts, such as aluminum parts, made by low pressure casting processes. A related object of this invention is to improve the quality of such molded metal parts by reducing the turbulence and exposure to air of the molten metal used in a low pressure casting process. A further object of this invention is to provide a low pressure casting process and apparatus in which a launder system is used to continuously supply molten metal to the holding furnace of a low pressure casting machine in less time and, accordingly, with less costs, than prior processes. Related objects are to provide a low pressure casting process and apparatus having a nearly uniform molten metal level at the beginning of each casting operation to reduce complications arising from the continuously decreasing molten metal levels encountered in the operation of conventional low pressure casting machines. By maintaining a substantially uniform level of molten metal in the holding furnace from one casting cycle to the next, the hydrostatic pressures created by the molten metal pool in the holding chamber and by the molten metal in the riser tube are essentially constant. Accordingly, the volume of pressurizing gas and the charging times and amounts are substantially uniform throughout a sequence of molding cycles so that faster cycle times and greater uniformity of cast parts are obtainable.

In accordance with this invention, molten metal is delivered from a metal master or reservoir furnace directly to the molten metal holding furnace of a low pressure casting machine by a launder assembly. As used herein, the terminology "master" or "reservoir" furnace is used to refer to any furnace, whether it be a melting furnace, a holding furnace, or a combination melting and holding furnace, which has a reservoir for a pool of molten metal that can be maintained at a substantially uniform level and from which molten metal may flow into one or more launder systems. A passageway for the molten metal through a valve within the launder assembly is closed when pressure is applied to the pool of molten metal in the holding furnace during a casting operation and opened when the casting operation is completed. The valve operating parts that contact the molten metal are desirably made from a material which is non-wetting, machinable to close tolerances, highly impermeable, highly stable under, or resistant to breaking down at, high temperatures and, in general, suitable for use with the molten non-ferrous metals for which the valve is used. Many different types of valves could be used in practicing the process of this invention, such as slide valves, gate valves and flapper valves. In a first embodiment depicted below, the valve comprises a cock-type valve having operating parts that comprise a valve body having a passageway formed by inlet and outlet conduits centered about a horizontal axis and a valve plug having a through bore rotatably mounted in the valve body. The materials used for the first embodiment must, in addition to the characteristics mentioned above, have a low frictional resistance to relative rotation. The outstanding material presently usable for the valve body and the valve plug of the first embodiment is believed to be graphite, for which several suppliers are available. Suitable materials include a high density graphite material known as PT-05 available from Pyrotek Incorporated of Spokane, Wash., and a material known as ATJ Graphite available from Metaullics Systems Company, L.P., of Solon, Ohio. The graphite materials are preferably lapped to enhance the engagement between their mating surfaces, for increased lubricity, and for durability, with molybdenum disulfide or with boron nitride over the mating surfaces of the valve body and the valve plug.

In a modification, the valve has a passageway formed by a port centered about a vertical axis and an axially-movable plug for opening and closing the port. For this embodiment, a ceramic material having the above-listed qualities is preferred. The presently preferred material for the valve plate and the valve plug of the modification is aluminum titanate. Presently available aluminum titanate ceramic material does not have a low resistance to relative movement and, for this reason, is not recommended for the relatively movable parts of the valve of the first embodiment.

In operation, the valve is opened to permit the molten metal pool within the melting furnace, the launder assembly and the holding furnace to seek a substantially uniform level. The valve is closed when a low pressure casting cycle is initiated after the molten metal within the holding furnace reaches a desired or predetermined minimum level. The metal level may be sensed by a level sensor that may be used to prevent initiation of a casting cycle when the height of the molten metal pool in the casting machine holding furnace is less than the desired or predetermined minimum. Optionally, the valve may be closed after being open for a predetermined period of time which can be determined by trial and error. Closure of the valve effectively divides the molten metal pool into two sections, one section including the molten metal in the melting furnace and the other section including the molten metal in the casting machine holding furnace. While the valve is closed, a pressurizing gas, such as nitrogen or dry air under pressure, is introduced into the holding furnace chamber above the level of the molten metal in the second section so that molten metal will rise up a riser tube into the cavity of a vented mold or other molten metal-receiving member situated at the top of the riser tube until the mold or other receiving member is filled. Shortly after the mold or other receiving member is filled with molten metal, the pressure of the gas is reduced so that the pressure in the second section of the molten metal pool lowers to or near to atmospheric pressure. This process can be repeated indefinitely to produce plural parts from molten metal.

Although graphite is the presently preferred material for use with a rotating valve plug for the reasons given above, graphite deteriorates rapidly when heated in the presence of oxygen. Further in accordance with this invention, the graphite parts of the valve assembly in which they are used are sealed from exposure to air by the molten metal. Other parts may be substantially protected and by enclosing them in a cover assembly which is filled with nitrogen or other suitable cover gas sufficient to replace the air in that area and, optionally, by covering them with a cover of ceramic material. Graphite would not be recommended for use with a valve having an axially movable plug because of the difficulty of protecting the plug and its stem from oxidation.

Although graphite materials which are easily machined are readily available for use in manufacturing valves in accordance with this invention, tests have indicated that some leakage of the molten aluminum around the valve plug from the valve body into the valve cover assembly may be encountered. In another aspect of this invention, the cover assembly has a chamber open to the valve plug which chamber is subjected to the same pressure as the pressure used to cause the molten aluminum to move upwardly through the riser tube. The cover assembly can be pressurized by introduction of the gas into the cover chamber from the same source of the gas used to pressurize the molten metal in the holding furnace. Of course, the gas in the cover chamber will serve also as a cover gas.

It is expected that the valves made and used in accordance with the teachings of this invention will require repair and replacement, in some cases at relatively frequent intervals. The casting operations will necessarily have to be interrupted when a valve is being repaired or replaced. Another object of this invention is to enable the valve assemblies of this invention to be quickly replaced. In furtherance of this object, the valve assembly includes a casing for the valve that is detachably connected to mating parts of the launder assembly and the entire valve operating mechanism is mounted on the casing. Accordingly, the entire valve assembly comprises a unitary structure that can be quickly removed and replaced.

Other objects and advantages will become apparent from the following description and the drawings.

DETAILED DESCRIPTION

Figure 1:
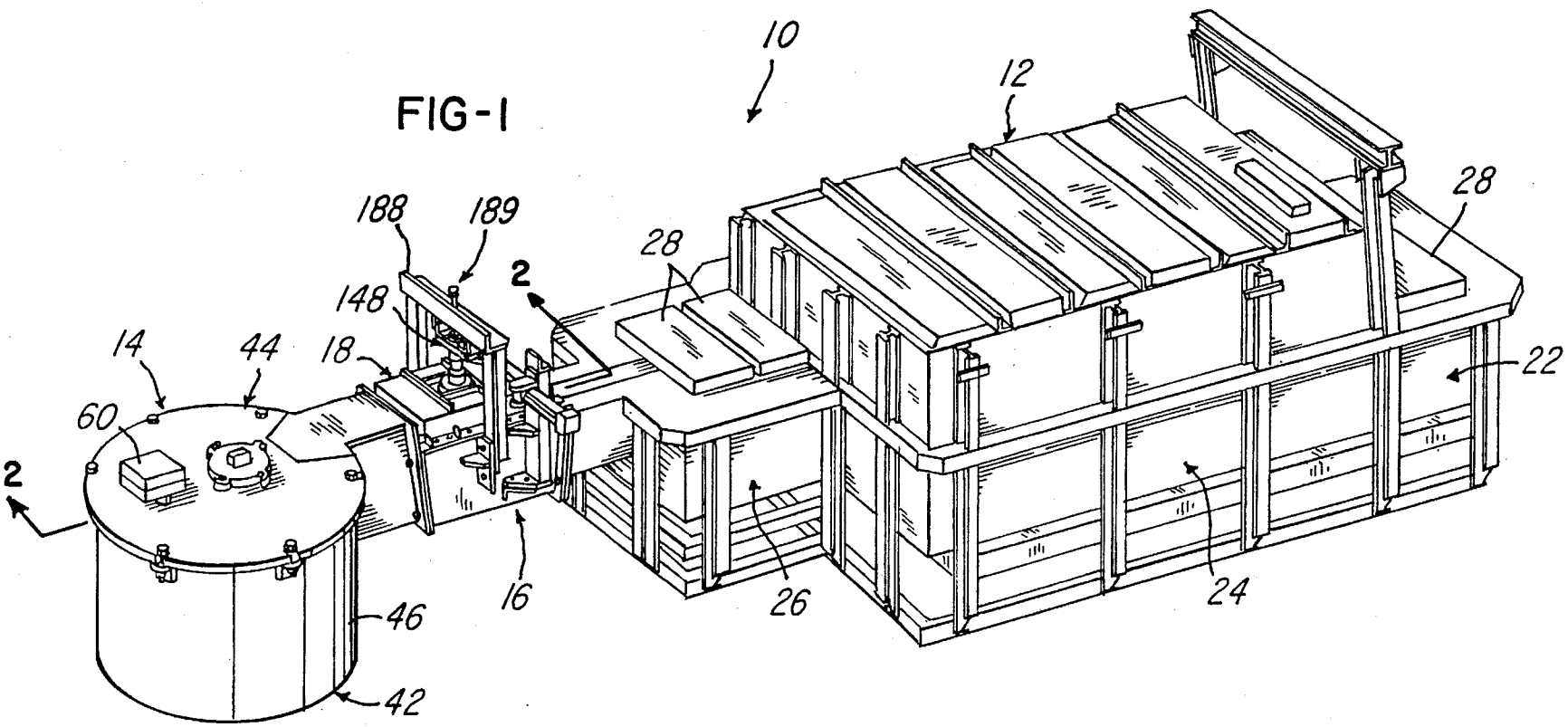
FIG. 1 is a simplified perspective view of a single station low pressure casting apparatus in accordance with this invention. (Here it may be noted that the drawings herein are simplified so that gas piping, air lines, valves, sensors, gauges, electrical wiring, and the like are, for the most part, not illustrated.)
Figures 2, 10:
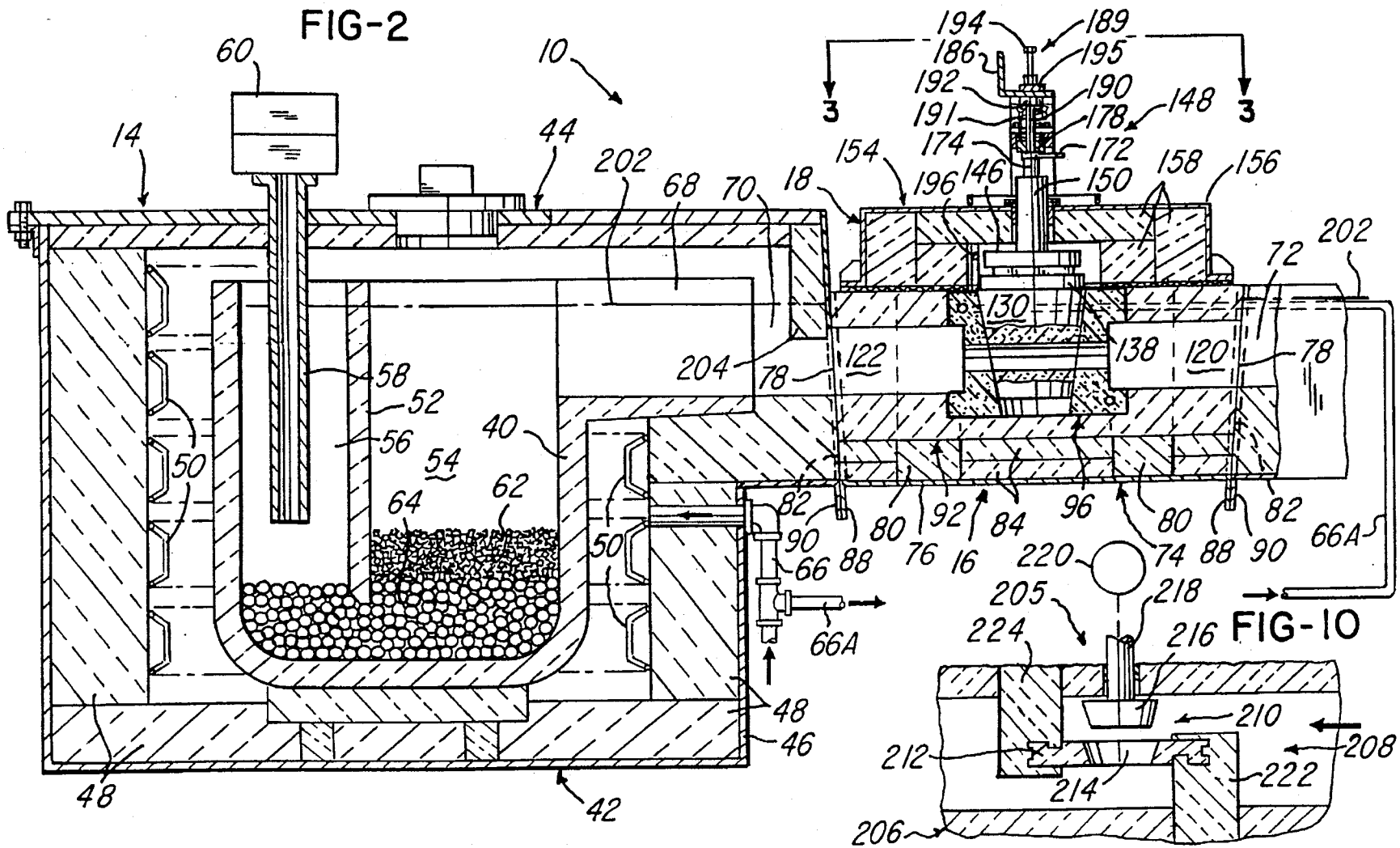
FIG. 2 is fragmentary cross-sectional view taken generally on line 2—2 of FIG. 1.
FIG. 10 is a simplified and partially diagrammatic cross-sectional view of another modified valve assembly in accordance with this invention.

Referring to FIGS. 1 and 2, a low pressure casting apparatus in accordance With this invention is generally designated 10 and comprises a reservoir or master furnace, generally designated 12, a low pressure casting machine, generally designated 14, and a launder assembly, generally designated 16, connecting the master furnace 12 to the casting machine 14. A valve assembly, generally designated 18, is incorporated into the launder assembly 16.

The particular master furnace 12 illustrated in the drawings comprises a melting furnace that includes a charging well 22, a thermal-head chamber section 24, and a discharge well 26. As previously noted, the master furnace is not necessarily a melting furnace. Many different configurations of melting furnaces, or melting and holding furnaces, which constitute or which supply molten aluminum to the master furnace are possible and may optionally be used in the practice of this invention. The charging well 22 and the discharge well 26 may be covered by a suitable well cover 28. The melting furnace 12 may be of a conventional electric or fossil fuel heated construction and the details of construction of the melting furnace 12 do not form part of this invention.

With continued reference to FIGS. 1 and 2, the low pressure casting machine 14 includes a molten aluminum holding vessel 40 forming part of a holding furnace, generally designated 42. The holding furnace 42 is covered and sealed by a cover plate assembly, generally designated 44. Furnace 42 includes a metal outer casing 46 and suitable insulation, illustrated in somewhat simplified form as comprising plural slabs or blocks 48 of refractory material. Plural heating elements 50 inside the furnace 42 maintain the aluminum bath in the holding vessel 40 in a molten state. Here it may be noted that the holding furnace 42 is of the type known as an electrically-heated crucible furnace, but such a furnace is merely one example of many different types of electrically or fossil fuel heated holding furnaces that could be used in the practice of this invention. Other examples include wet bath reverberatory furnaces, dosing furnaces, furnaces heated by immersion heaters, and induction furnaces. The particular kind of holding furnace with which this invention may be used will be selected by the furnace user and no one kind is necessarily preferred over any other kind.

Optionally, the holding vessel 40 is partly divided by a baffle 52 into a molten aluminum inlet side 54 and a molten aluminum outlet side 56. During operation of the casting machine 14, molten aluminum from the outlet side 56 is forced upwardly through a riser tube 58 into a suitable vented mold assembly or other molten metal-receiving member 60. The mold assembly or other molten metal-receiving member 60 may be entirely conventional and are not further illustrated or described herein. Molten aluminum entering the inlet side 54 may, if desired, be filtered as it flows to the outlet side 56 by a filter 62, which may comprise small pebbles of alumina, supported above the bottom of the holding vessel 40 by larger balls 64 of alumina. For reasons discussed below, a suitable gas under pressure, such as nitrogen or dry air, is introduced into the casting machine 14 by means of piping 66.

It should be noted that the casting machine 14 of FIG. 1 is illustrated in a highly simplified manner. The mold assembly or molten metal-receiving assembly 60 is only diagrammatically illustrated. This invention can be practiced with many various different types of mold assemblies, such as permanent molds or sand molds—provided only that any such mold assembly includes a mold which can be prepared so that its cavity (not shown) is open to the upper end of the riser tube 58 for receiving molten aluminum therefrom, and further that the mold can be opened to permit removal of the molded part after it has solidified. This invention may also be used with other molten metal-receiving members assembled in alignment with the riser tube 58 such as, for example, receiving members (not shown) having a cavity open to the riser tube 58 for receipt of a charge of molten metal and from which the molten metal is discharged by a piston into a mold assembly which is not aligned with the riser tube 58. FIG. 1 also does not show any mechanisms for handling or supporting the mold assembly or other molten metal-receiving member 60 but it will be understood that some such mechanisms will be used. This invention is not concerned with such mechanisms, many of which are known.

The holding vessel 40 has an open spout 68 at its upper end which is open to a first launder section or trough 70 that forms part of the aforementioned launder assembly 16. Launder assembly 16 also includes a second launder section or trough 72 open to the furnace discharge well 26. Both launder sections or troughs 70 and 72 are open to the valve assembly 18. The first section 70 is downstream of the valve assembly 18 and is referred to herein as the downstream launder section. Second section 72, being upstream of the valve assembly 18, is considered to be the upstream launder section or trough.

With reference to FIGS. 2 through 6, the valve assembly 18 includes a U-shaped or trough-like valve support, generally designated 74, comprising a metal support casing 76 having upwardly and outwardly flared or tapered ends 78 which mate with cooperating tapered end surfaces of the launder sections 70 and 72. A pair of mutually-spaced, cradle-forming, U-shaped cross members 80 made from a rigid refractory material, such as low density calcium silicate boards, are supported on the inside bottom wall and span transversely across the inside sidewalls of the metal valve support casing 76. In addition, the inside bottom wall and the inside sidewalls of the metal casing 76 are lined with high temperature insulating materials 84 that form U-shaped linings covering, along with the cross members 80, the inside bottom and sides of the metal casing 76. Insulating materials 84 may comprise mineral wool, fiberglass, and refractories. The casing 76 also has a pair of parallel mounting flanges 86 extending along its longitudinally-extending top edges and U-shaped mounting flanges 88 bordering its leading and trailing ends 82. The U-shaped mounting flanges 88 are aligned with and connected by bolts to U-shaped flanges 90 projecting from the adjacent ends of the launder sections 70 and 72 in the cooperating parts of the launder assembly 16.

Figure 5:
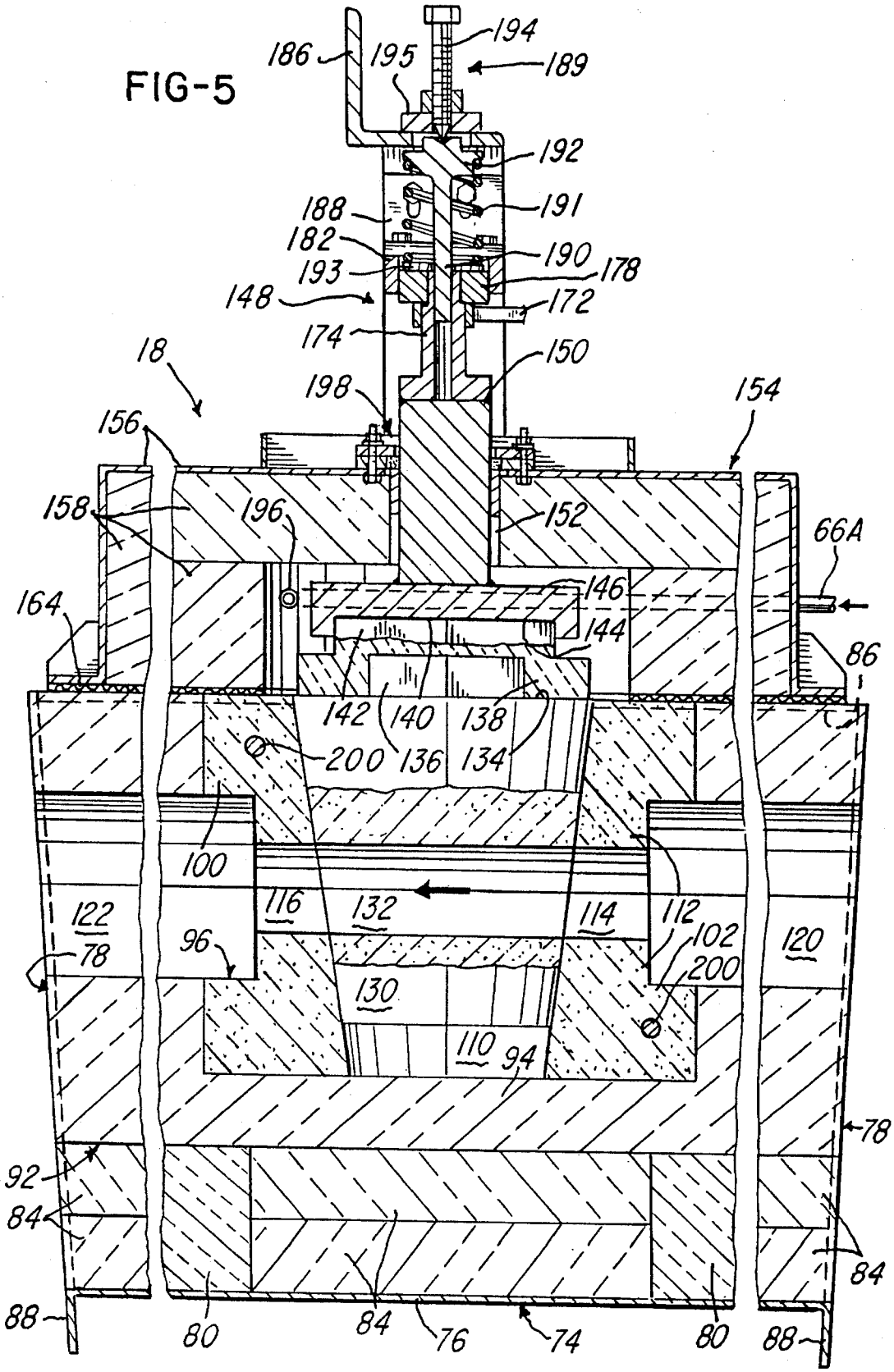
FIG. 5 is cross-sectional view of the valve assembly taken on line 5—5 of FIG. 3.
Figure 6:
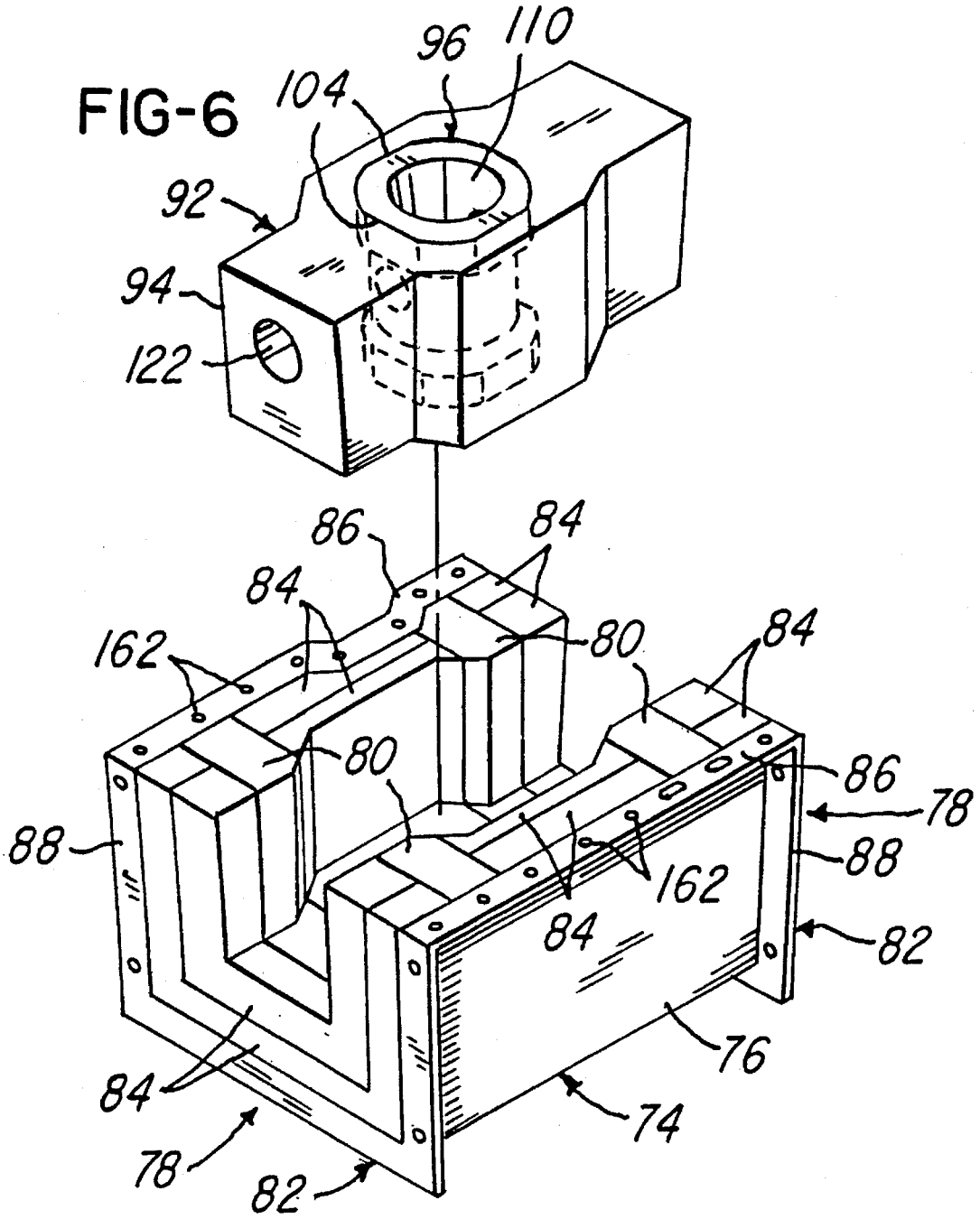
FIG. 6 is a partly exploded, perspective view of a lined casing and a composite valve body that form parts of the valve assembly of FIGS. 1 through 5.
Figure 7:
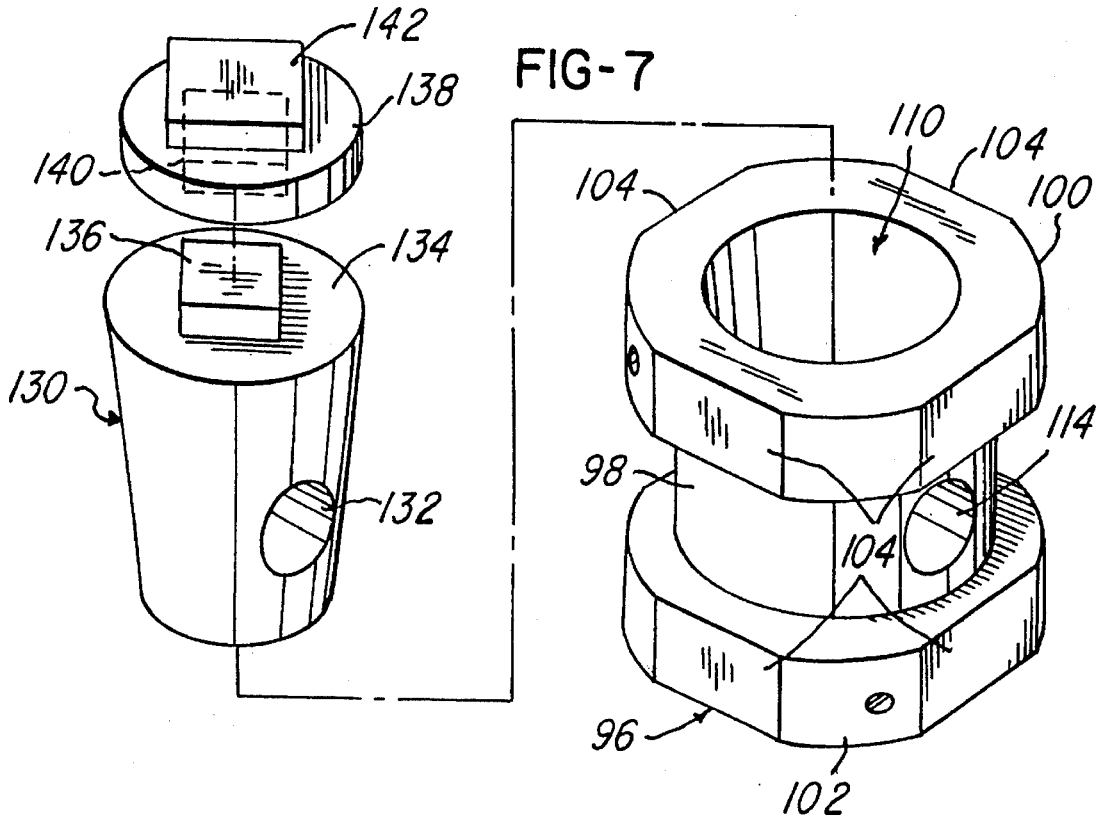
FIG. 7 is an exploded perspective view of a valve port element, a valve plug, and a valve plug cap forming part of the valve assembly of FIGS. 1 through 5.

As best illustrated in FIGS. 5, 6 and 7, an elongate, generally rectangular valve housing 92 formed from a matrix 94 of refractory material is supported or cradled by the cross members 80 and a vertically-oriented, spool-shaped valve body 96 made from graphite is embedded in the matrix 94. Refractory materials suitable for forming the matrix 94 include castable refractories, ramming mixes, refractory cements, and preformed shapes. The valve body 96 comprises a cylindrical center section 98, a generally cylindrical upper or head section 100, and a generally cylindrical lower or base section 102. Head section 100 and base section 102 are of a larger diameter than the center section 98. Flats 104 on both the head section 100 and the base section 102 are provided to prevent the valve body 96 from rotating relative to the refractory matrix 94. All three body sections 98, 100 and 102 are coaxial about a common vertical axis.

A vertical valve plug cavity 110 having a generally conical inner wall extends from the top to the bottom of the valve body 96 along its vertical centerline. The cavity 110 is defined in part by wall portions 112 in the center body section 98. A valve port is formed by an upstream, inlet bore or port section 114 and a downstream, outlet bore or port section 116, both of which open to the plug cavity 110. The inlet and outlet port sections 114 and 116 are mutually coaxially centered on a horizontal axis extending diametrically through the plug cavity 110. Mutually aligned inlet and outlet conduits, designated 120 and 122, respectively, are formed in the castable matrix 94 in alignment with the respective inlet and outlet bores 114 and 116 in the valve body 96.

A valve plug 130 made from graphite in the form of a truncated cone is rotatably mounted in the valve plug cavity 110 Valve plug 130 has a horizontal through bore 132 which is centered on the same horizontal axis as the inlet and outlet conduits 120 and 122. Upon rotation of the valve plug 130, the through bore 132 can be rotationally oriented in alignment with the inlet and outlet bores 114 and 116, at which time the valve assembly 18 can be considered to be "open", or it can be rotationally oriented completely out of alignment with the inlet and outlet bores 114 and 116, at which time the valve assembly 18 can be said to be "closed".

The upper surface, designated 134, of the graphite valve plug 130 is preferably flush with the top surface of the head section 100 of the valve body 96. In addition, a rectangular boss 136, which is also made from graphite and is integral with the plug 130, projects upwardly from the center of the upper plug surface 134. Boss 136 functions as a driven coupling used to rotate the valve plug 130, as will be described below. A ceramic cap 138, which may be made from aluminum titanate, overlies the upper surface 134 of the valve plug 130 and the boss 136 to protect the underlying top of the valve plug 130 and boss 136 from being exposed to oxygen. Cap 138 has a recessed, rectangular pocket 140 that mates with the boss 136 and further has an upwardly-projecting, rectangular boss 142 so that the cap 138 can function as a rectangular drive transmission coupling. Boss 142 in turn is received by and mates with a pocket 144 in a metal drive coupling 146 that forms part of a valve operating assembly, generally designated 148. As best shown in FIG. 5, the ceramic cap 138 has a diameter which is smaller than the diameter of the top surface of the valve plug 130 and, therefore, does not entirely cover the valve plug 130. Although this leaves a portion of the valve plug 130 unprotected by the ceramic cap 138, this construction enables the valve plug 130, as it becomes worn through use, to gradually lower part way into the valve plug cavity 110 without causing rubbing contact to occur between the ceramic cap 138 and the valve wall portions 112.

Figure 3:
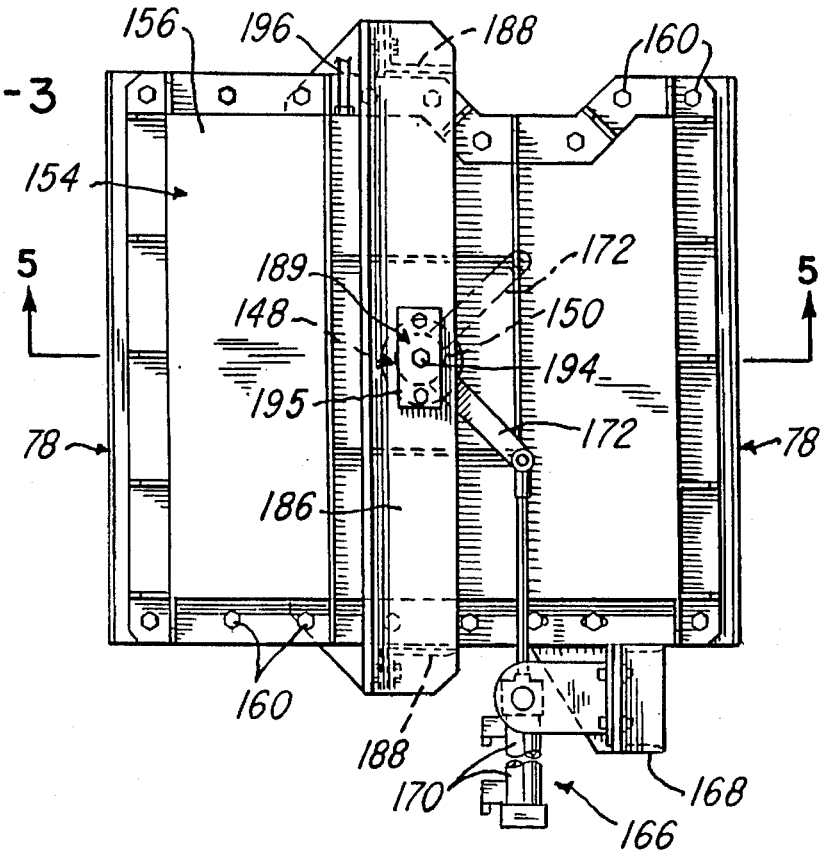
FIG. 3 is a top plan view taken in the direction of arrows 3—3 of FIG. 2 and showing a valve assembly forming part of the apparatus of this invention.
Figure 4:
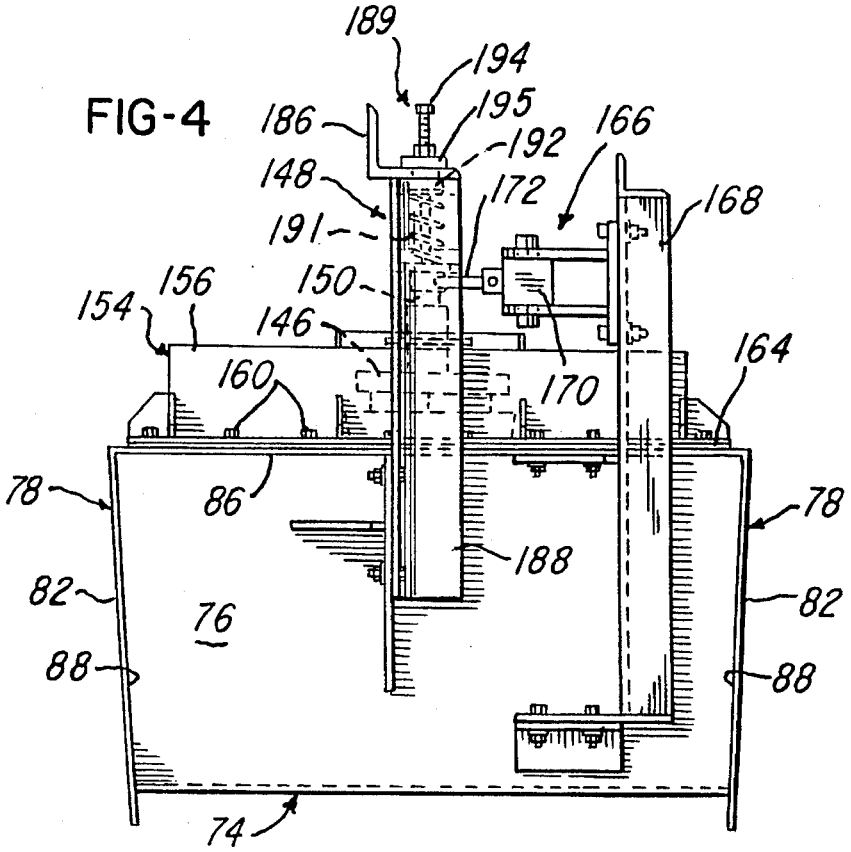
FIG. 4 is side elevational view of the valve assembly of FIG. 3.

With reference to FIGS. 1 through 5, the drive coupling 146 is affixed to the bottom end of a vertical drive shaft 150 that extends through a central through bore 152 in a valve cover assembly, generally designated 154. Cover assembly 154 comprises an inverted box-like rectangular metal casing 156 with a high temperature insulating lining 158, such as an refractory ceramic fiber board or a mineral wool bat, supported on top of the metal valve support casing 76 to which it is connected, as shown in FIGS. 3 and 4, by mounting bolts 160 which extend through bolt holes 162 (FIG. 6) in the parallel mounting flanges 86. A lining paper 164 of insulating refractory material, such as a refractory fiber paper, between the lower surface of the cover assembly 154 and the upper surface of the valve support 74 provides a gas-tight seal therebetween.

Figure 8:
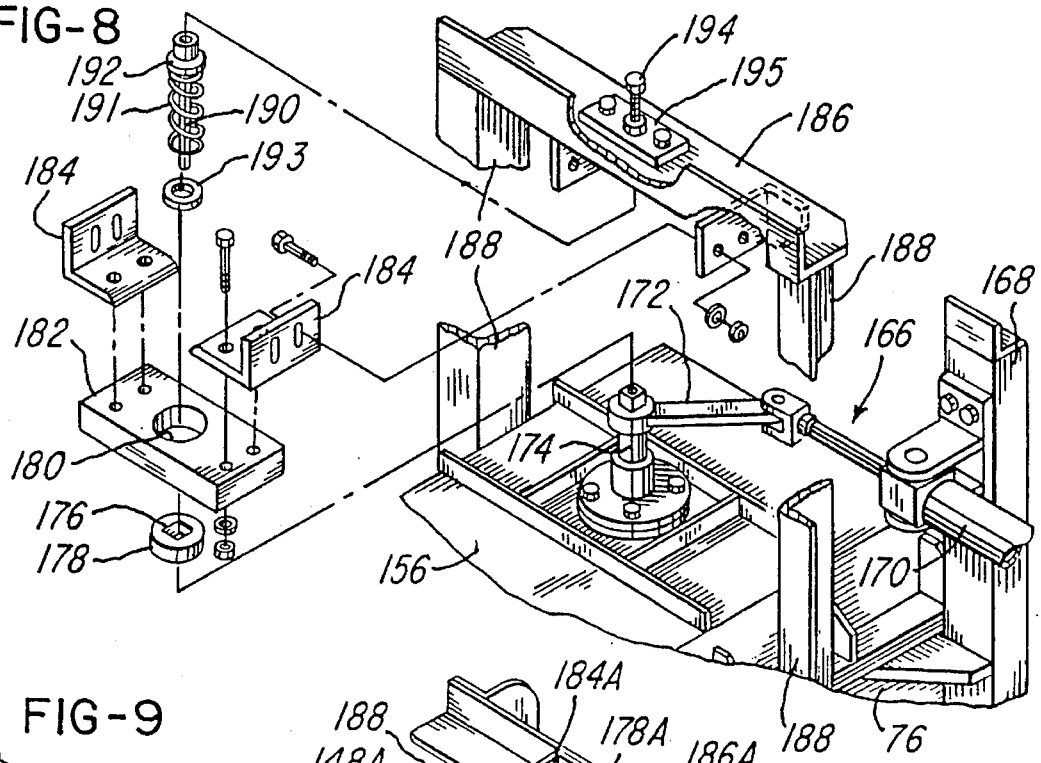
FIG. 8 is a fragmentary, partially exploded, perspective view of a portion of the valve operating assembly of FIG. 3.

With continued reference to FIGS. 1 through 5, and also to FIG. 8, the drive shaft 150 is rotatably driven about its vertical, longitudinal axis by a rotary drive mechanism, generally designated 166, mounted on a support post 168 affixed to one side of the metal valve support casing 76 and comprising an air actuator 170 having a piston rod connected by a link 172 to a hollow, tubular fitting 174 affixed as by welding to the top of the drive shaft 150. As is apparent, rotation of the drive shaft 150 is imparted to the valve plug 130. To insure that the movement of the valve plug 130 is purely rotational, the upper end of the tubular fitting 174 has a square cross section and is held vertically centered within a mating square bore 176 in a disc-shaped, lubricant-impregnated bearing 178 that is slidably and rotationally received within a vertical through bore 180 in a bearing guide plate 182 affixed by bracket assemblies 184 to the bottom of a horizontal cross beam 186 connected by vertical legs 188 to the sides of the valve support casing 76. The disc-shaped bearing 178 bears against an upwardly-facing shoulder formed near the top of the drive shaft fitting 174. The bracket assemblies 184 and the bearing guide plate 182 have cooperating bolt-receiving slots and holes to enable the location of the through bore 180 in the bearing guide plate 182 to be accurately adjusted to ensure centering of the tubular fitting 174, and thereby to insure that the drive shaft 150 and the valve plug 130 are confined for rotation about a vertical axis.

To resist any tendency of the valve plug 130 to move upwardly, and also to accommodate the lowering of the valve plug 130 into the valve plug cavity 110 as the parts become worn, the valve operating assembly 148 is provided with a self-adjusting hold down assembly, generally designated 189. The hold down assembly 189 is provided with a spring centering shaft 190 which slidably extends into the hollow interior of the tubular drive shaft fitting 174. A compression spring 191 is coiled about the centering shaft 190 and confined between an enlarged head 192 at the top of the centering shaft 190 and a washer 193 that overlies the disc-shaped bearing 178 which bears downwardly onto an upwardly-facing shoulder formed near the top of the drive-shaft fitting 174. As is evident from an inspection of FIG. 5, for example, the compression spring 191 biases the disc-shaped bearing 178 downwardly, which in turns maintains a downward pressure on the drive shaft 150 and the valve plug 130. At the same time, the compression spring 191 biases the centering shaft 190 upwardly against a needle-shaped lower end of a threaded bearing screw 194 which is threadedly received in threaded bores in mounting plates 195 mounted on the horizontal cross beam 186. As apparent, the bearing screw 194 enables the spring centering shaft 190 to move laterally as may be needed to accommodate to slightly different adjusted positions of the disc-shaped bearing 178 in order to prevent a binding of the parts of the valve operating assembly 148.

Further in the interest of preventing oxygen from engaging the graphite valve parts, namely the valve body 96 and the valve plug 130, nitrogen or another suitable cover gas under low pressure is preferably introduced into the valve cover assembly 154 through a gas inlet fitting 196 that extends through a sidewall of the cover assembly 154 and that is connected to a nitrogen gas source (not shown). A packing gland assembly 198 of conventional construction is used to provide a seal between the drive shaft 150 and the cover assembly 154.

Accidental leakage of molten metal may occur around the valve plug 130 into the cover assembly 154 due in part to the pressurizing of the holding furnace 44. This problem can effectively be reduced or eliminated altogether by connecting the gas inlet fitting 196 to the pressurizing gas piping 66, as diagrammatically shown in FIG. 2, by branch piping 66A leading from the piping 66 to the gas inlet fitting 196. By this construction, the pressure of the gas above the valve plug 130 will increase and decrease simultaneously with, and will be substantially the same as, the pressure exerted on the molten aluminum in the valve body 96 below the valve plug 130 when the holding furnace is pressurized, thus counteracting the pressure tending to cause the molten aluminum to leak upwardly around the valve plug 130 during operation of the casting apparatus 10. The method of operation of the apparatus 10 of FIGS. 1 through 7 will now be described. In advance of the operation of the apparatus 10 to produce cast parts, the valve assembly 18 may be preheated by heating elements 200 (shown in cross section in FIG. 5) to prevent the molten aluminum from solidifying at the beginning of the first casting operation. At the beginning of the operation of the casting apparatus 10, aluminum melted in the melting furnace 12 is released into the launder assembly 16 and the valve plug 130 is rotationally oriented in its open position shown in FIGS. 2 and 5. Accordingly, the molten aluminum within the launder assembly 16 will flow through the valve plug 130, in the direction of the arrow in FIG. 5, to fill the holding vessel 40 so that the top level of the molten aluminum pool in the melting furnace 12, the launder assembly 16 and the holding vessel 40 will be uniform throughout. A satisfactory level for the top of the molten aluminum pool is designated by line 202 in FIGS. 2. It will be noted that the line 202 is completely above the inlet and outlet conduits 120 and 122 of the valve assembly 18. Accordingly, the molten aluminum in the conduits 120 and 122 prevents air from entering the conduits 120 and 122 and reaching the graphite valve body 96 and valve plug 130. While the valve plug 130 is rotated to the open position, a suitable mold assembly or other molten metal-receiving member 60 is prepared to have its molten metal-receiving cavity in open communication with the top of the riser tube 58. If the mold assembly is a sand mold, a new sand mold is positioned over the riser tube 58; if a permanent mold or other molten metal-receiving member, it is positioned so that its cavity, which is, of course, empty, is open to the riser tube 58. After the molten aluminum has reached a desired level in the holding vessel 40, the valve assembly 18 is closed by rotation of the valve plug 130 by energization of the valve-operating air actuator 170 so that the plug through bore 132 is completely out of alignment with the valve body inlet and outlet bores 114 and 116. The bores 114, 116, and 132 are completely below the top line 202 of the molten aluminum pool in the apparatus 10. For this reason, and because only a simple rotation of the valve plug 130 is required to close the valve assembly 18, closure of the valve assembly 18 will cause little or no agitation of the molten aluminum. As a precaution, a skimming gate 204, which extends below the line 202, may be provided between the downstream end of the valve assembly 18 and the spout 68.

Closure of the valve assembly 18 effectively divides the molten aluminum pool into two sections, one section including the molten aluminum in the melting furnace 12 and the other section including the molten aluminum in the casting machine holding vessel 40. While the valve assembly 18 is closed, a pressurizing gas, such as nitrogen or dry air under relatively low pressure, on the order of three to ten pounds per square inch, is introduced into the hollow interior of the casting machine holding furnace 42 through the piping 66 by the opening of a control valve (not shown) connected in the piping 66. The pressurizing gas flows around the holding vessel 40 and over the top 202 of the aluminum pool of the above-mentioned second section, thus creating pressure over the entire area of the second section of the aluminum pool, which extends from the closed valve plug 130 to, and including, the holding vessel 40. (At the same time, if piping 66*a* is used, the same pressure will be created inside the valve cover assembly 154.) Accordingly, molten aluminum rises in the riser tube 58 into the mold assembly or other-molten metal-receiving member 60, filling the metal-receiving cavity therein. The mass of molten aluminum within the mold assembly or other molten metal-receiving member 60 is either removed from the cavity therein or else, because remote from the heating elements 50 and otherwise unheated, is permitted to cool and solidify, thus completing the formation of a molded part. The mold can then be opened and the molded part removed.

When it becomes possible to permit the molten metal in the riser tube 58 to return to the holding vessel 40 without interfering with the molding operation or damaging the part being molded, the pressure in the holding vessel 40 is reduced to or near to atmospheric pressure by, for example, exhausting the pressurizing gas to the surrounding air through an exhaust valve (not shown) in the piping system 66. At about the same time, the valve assembly 18 can be opened by a reverse operation of the air actuator 170, thereby causing the valve plug 130 to return to its open position illustrated in FIGS. 2 and 5. The pool of molten aluminum will then seek to return to a uniform level throughout the apparatus 10, resulting in an elevation of the level of the molten aluminum in the holding vessel 40, so that the foregoing operations can be repeated for casting another part from aluminum. These operations can be repeated as many times as needed for successively casting any desired number of parts.

The desired elevation of the molten metal in the holding vessel 40 at the beginning of each casting cycle may be sensed by a suitable known metal-level sensor (not shown) which can be used to trigger the next casting cycle. Optionally, the start of the next casting operation, i.e. the closing of the valve 18, may be initiated in timed relation to the opening of the valve assembly 18 at the end of the preceding casting operation since the rise in the metal level in the holding vessel 40 over a predetermined period of time is highly predictable.

The metal level within the holding vessel 40 will be substantially uniform as each casting operation is commenced. Accordingly, the pressure level and volume of the pressurizing gas will be uniform from one casting operation to the next. This means that production variables resulting in substantial differences in metal levels at the beginnings of successive casting operations are avoided with the practice of this invention. Accordingly, parts cast using the process and apparatus of this invention can be made to uniform standards of quality.

With reference to FIG. 2, the bottom of the troughs in the launder assembly 16 are preferably in the same plane as the bottoms of the inlet and outlet conduits 120 and 122 of the valve assembly 18. Preferably, the valve inlet and outlet bores 114 and 116 along with the valve plug through bore 132 are of smaller cross-sectional dimension than the inlet and outlet conduits 120 and 122. By proper charging and operation of the apparatus 10, the level of the molten aluminum within the portions of the launder assembly 16 between the melting furnace 12 and the valve assembly 18 may rise slightly when the valve assembly 18 is closed during a molding cycle and lower slightly when the valve assembly 18 is opened after the completion of a molding cycle. Also, the level of the molten aluminum pool within the holding vessel 40 and its spout 68 will lower slightly during each molding cycle due to the mass of metal that travels up the riser tube 58 and fills the cavity in the mold assembly or other molten metal-receiving member 60, and will then rise slightly after the valve assembly 18 is opened after completion of the molding cycle due to the tendency of the molten aluminum to seek a uniform level throughout the apparatus 10. However, the degree of change in the molten aluminum level throughout the apparatus 10 is so small, and therefore takes place at such a slow pace, that any molten aluminum turbulence is minimal. The molten aluminum pool, once it has been created, remains essentially passive for the entire time the apparatus 10 is used. Accordingly, the molten aluminum supplied to the holding vessel 40 will be essentially unaffected by turbulence and should be uniformly dense and inclusion free and its quality essentially undiminished by the casting process.

The entire valve assembly 18 may be removed as an integral unit from between the U-shaped flanges 90 of the launder trough sections 70 and 72 for repair or replacement by simply removing the bolts by which the casing is connected to the mating launder flanges 90, disconnecting the air lines (not shown) to the air actuator 170, and disconnecting the electrical connections to the heating elements 200, if used. A replacement valve assembly may be as quickly and easily connected into the launder assembly. The sloping or tapered ends 78 of the valve assembly 18 ensure that the valve assembly 18 can be easily and quickly removed and replaced and that it will be properly seated in the launder assembly 16. Also, with the use of gaskets (not shown) between the mutually-confronting and tapered end faces of the valve assembly 18 and the launder sections 70 and 72, a metal and gas tight seal is formed therebetween.

The launder sections 70 and 72 may be quite short and, if so, need not be heated. In fact, the downstream launder section 70 is so short that some may consider it to be part of the casting machine holding furnace 42. The downstream launder sections in the practice of this invention will likely always be quite short and effectively incorporated in the holding furnaces of the casting machines with which they are used. The upstream launder sections may be quite long and, if so, it may be necessary, as known by those familiar with the art, to provide heaters spaced along their lengths.

A feature of the apparatus 10 is that the top of the downstream launder trough 70 is coplanar with the top of the holding vessel 40 so that the molten metal level within the launder trough 70 rises and falls with the level of the molten metal within the holding vessel 40 and its spout 68. In contrast, the conduits in the valve body and the through bore in the valve plug are submerged in, and normally filled by, the molten metal in the launder system. It will be apparent that the launder assembly could comprise closed conduits (not shown) that open to the melting furnace and to the holding chamber of the casting machine below the normal levels of the molten metal in them. Such practice is not uncommon for launders used in die casting processes.

Figure 9:
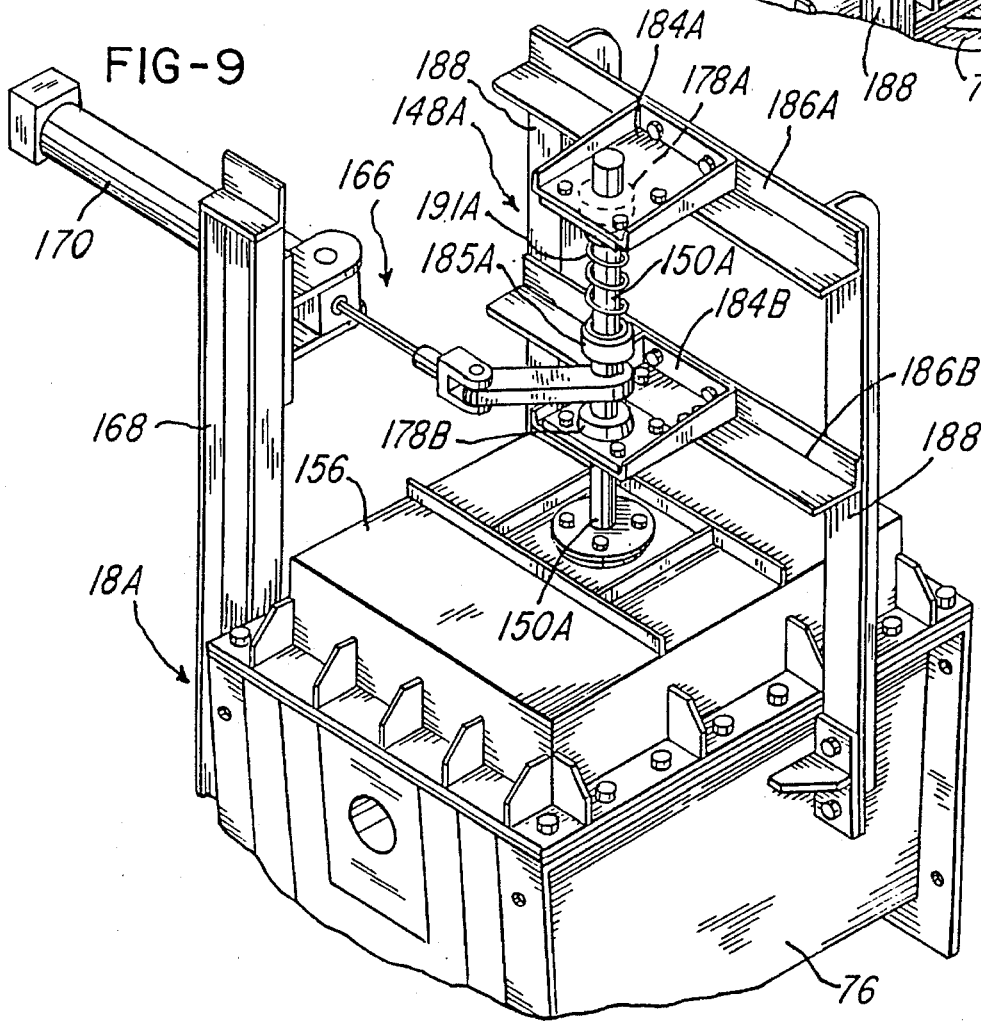
FIG. 9 is a fragmentary, perspective view of a modified valve assembly in accordance with this invention.

FIG. 9 shows a modified valve assembly, generally designated 18A which may be essentially the same as the valve assembly 18 of FIGS. 1 through 7, but has a valve operating assembly, designated 148A, which has a vertical drive shaft 150A that extends upwardly through a mutually spaced pair of bearings 178A and 178B that are supported by brackets 184A and 184B mounted on upper and lower cross beams 186A and 186B, respectively. The bearings 178A and 178B are connected to the brackets 184A and 184B, respectively, by mounting plates 187A. Plates 187A are held by fasteners in horizontally adjustable positions so that the bearings 178A and 178B may be accurately centered with respect to the drive shaft 150A. A compression spring 191A bears against the bottom of the top bearing 184A and a collar 185A affixed to the drive shaft 150A to bias the drive shaft 150A and, accordingly, the valve plug (not shown) downwardly. The function of the valve operating assembly 148A of FIG. 9 is mostly the same as the operating assembly 148 of the first embodiment illustrated in FIGS. 1 through 7. The structure of FIG. 9 is presently preferred for use with graphite valve plugs, such as the plug 130, because the single bearing 178 in the embodiment of FIGS. 1 through 7, may not provide adequate resistance to sideways or horizontal forces acting on the valve plug 130 when it is rotated by operation of the air actuator 170. Such horizontally directed forces can cause the outer surface of the valve plug 130 to forcibly rub against the confronting surfaces of the valve plug cavity 110, thug creating areas of high wear. The two bearings 178A and 178B of FIG. 9 are effective to absorb the horizontally directed forces that otherwise would act on the valve plug 130 and thereby substantially reduce the wearing away of the surfaces of the valve plug 130 and the valve plug cavity 110.

Figure 12:
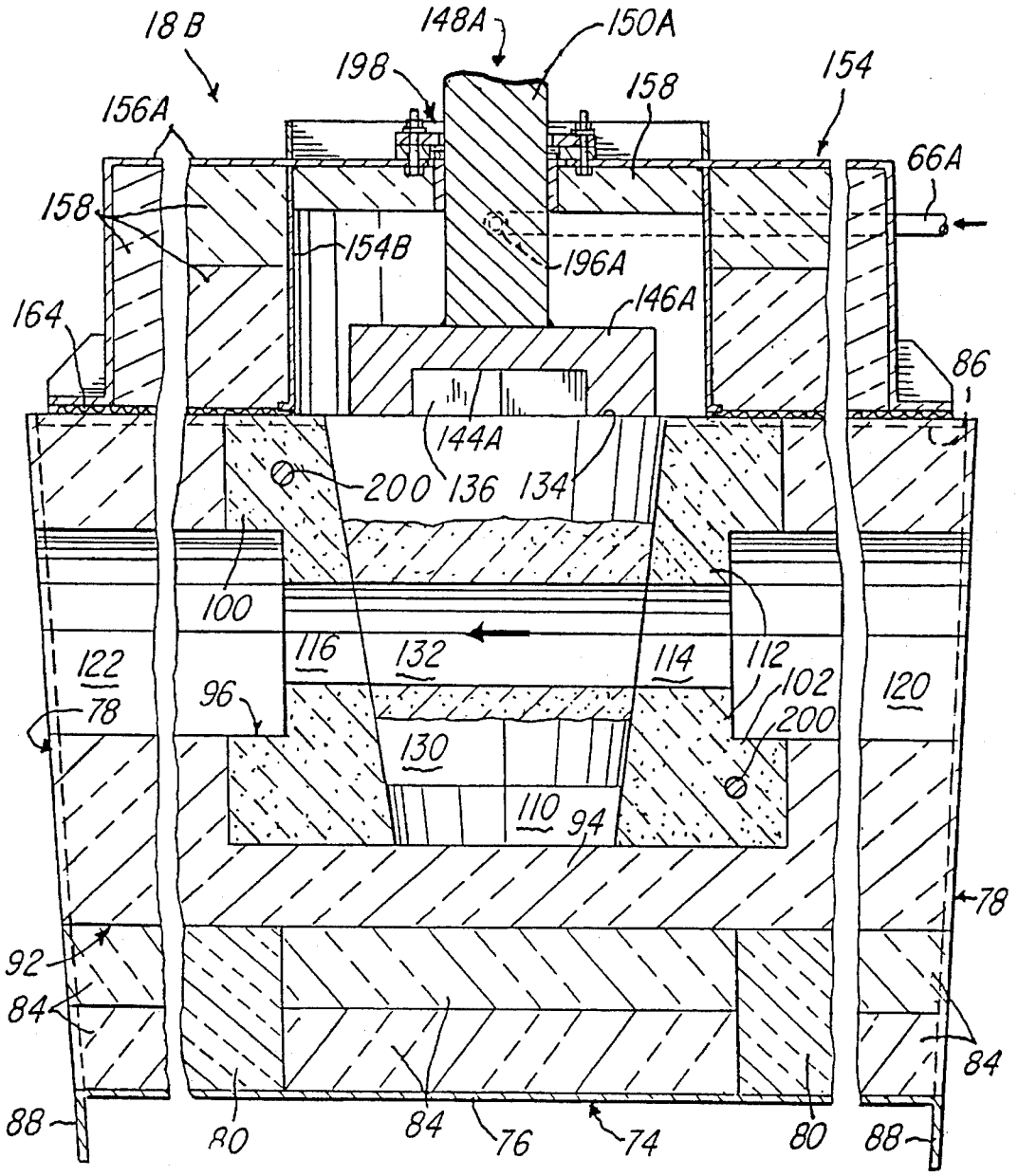
FIG. 12 is a fragmentary cross-sectional view of still another modified valve assembly.

FIG. 12 shows a presently preferred embodiment of a valve assembly, designated 18B, which is similar to the valve assembly 18 of FIGS. 1 through 7 but includes a valve operating assembly 148A which is preferably essentially identical to the valve operating assembly 148A of FIG. 9. Parts in FIG. 12 that essentially duplicate parts of FIGS. 5 or 9 are given like reference numbers. In FIG. 12, the valve operating assembly 148A includes a boss 136 received by and mating with a pocket 144A in a metal drive coupling 146A affixed to the bottom of the vertical drive shaft 150A. The ceramic cap 138 is not used in the embodiment of FIG. 12 because such caps may not have the structural integrity to provide a satisfactory drive coupling to the valve plug 130. In FIG. 12, the piping 66A is shown connected to a nipple 196A that is located on a transverse centerline of the valve body 96. To reduce the possibility that the valve cover plate, designated 156A in FIG. 12, may flex or "oil-can" due to the pressure of the nitrogen gas supplied thereto, a hollow, cylindrical compression sleeve 154B, which adds structural strength to the valve cover plate 156A, is welded to the bottom of the valve cover plate 156A. The bottom of the sleeve 154B has an outwardly projecting flange that bears against and slightly compresses the refractory paper lining 164 to provide a good seal.

Another modified valve assembly, generally designated 205, is illustrated in FIG. 10. Valve assembly 205 comprises a valve housing 206 which may be inserted in a launder assembly of the type illustrated in FIG. 1 in lieu of the valve assembly 18. Housing 206 has a longitudinally-extending conduit 208 along which molten aluminum may flow in the direction of the arrow in FIG. 10 from a melting furnace (not shown) to a casting furnace (not shown). The flow of molten aluminum through the conduit 208 is uninterrupted except by a valve body assembly, generally designated 210, including a horizontal valve plate 212. Valve plate 212 has a valve port 214 centered about a vertical axis and defined by a circular wall in the shape of a truncated cone. An axially movable valve plug 216 having a stem 218 is centered on the same vertical axis as the port 214 and can be driven vertically by an air actuator 220 to which it is connected in any suitable fashion. Valve plug 216 is also in the shape of a truncated cone so that, when lowered, it will fully close the valve port 214. In addition to the valve plate 212, valve body assembly 210 includes a pair of support members 222 and 224 spanning across the conduit 208. Support members 222 and 224 are preferably made from matrixes of castable refractory material. Support member 222 supports the upstream or inlet edge of the valve plate 212 and spans across and projects upwardly from the bottom of the valve conduit 208. Support member 224 supports the downstream or outlet edge of the valve plate 212 and spans across and projects downwardly from the top of the conduit 208. It will be noted that the support members 222 and 224 are embedded in the refractory material lining the top and bottom walls of the conduit 208. Accordingly, molten aluminum flowing through the valve housing 206 to refill its associated low pressure casting machine holding furnace will flow over the inlet support member 222, downwardly through the port 214, and Under the outlet support member 224. The function and sequence of operation of the modified valve assembly 205 of FIG. 10 are the same as the valve assembly 18 of FIGS. 1 to 7. The side edges of the support members 222 and 224 and also the side edges of the valve plate although not shown, are preferably embedded in the sidewalls of the conduit 208 so that, upon closure of the valve assembly 205 by entry of the valve plug 216 into the port 214, will result in a sealing of the valve assembly 205 to prevent escape of the pressurizing gas into the upstream or inlet side of the valve assembly 205. The valve plate 212 and the valve plug 216, including its stem 218, are preferably made from a non-wetting ceramic material. An aluminum titanate ceramic material is preferred, such as a material known as AT-80 available from Coors Ceramic Company of Golden, Colo.

Figure 11:
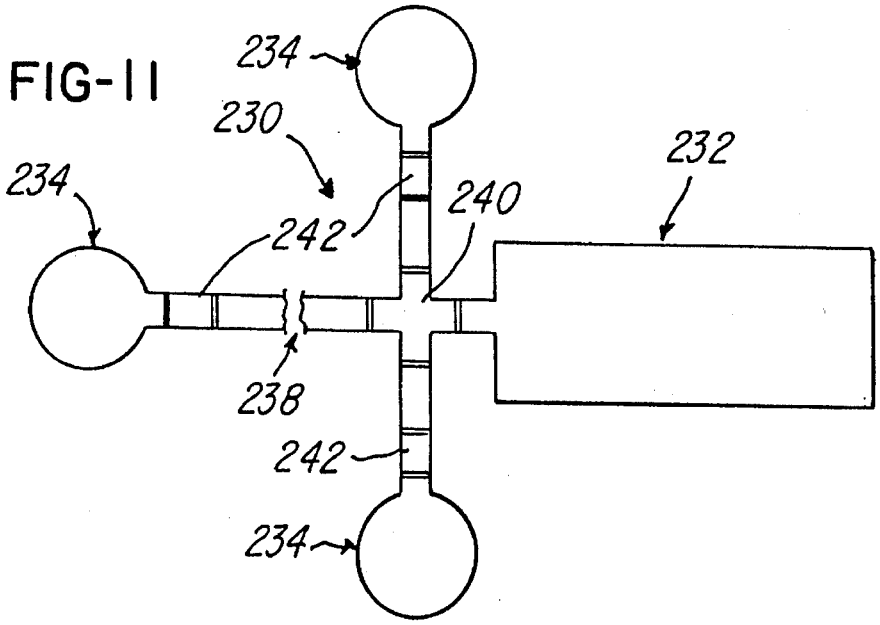
FIG. 11 is a diagrammatic plan view of a multiple station casting apparatus in accordance with this invention.

FIG. 11 diagrammatically shows a modified low pressure casting apparatus, generally designated 230, which has a single melting furnace 232 that supplies molten aluminum to plural low pressure casting machines 234 by a launder assembly 238 having plural sections connected to the melting furnace 232 by a cross member 240. A valve assembly 242, which may be identical to the valve assembly 18 or to the modified valve assembly 208, is located immediately adjacent each casting machine 234 and used in conjunction therewith. The apparatus 230 of FIG. 11 differs from the apparatus 10 of FIG. 1 only because the apparatus 230 of FIG. 11 has more than one casting machine and a launder assembly adequate to be used with the plural casting machines, the launder assembly including plural valve assemblies, one for each casting machine. The function and sequence of operation of each valve assembly 242 of FIG. 11 are the same as the valve assembly 18 of FIGS. 1 through 7.

Conventional machine controls may be used to sequentially control the operations of the embodiments of this invention. Since conventional, no further description thereof is included herein.

The process and apparatus are described above for use in processes for casting aluminum. As previously mentioned, aluminum is but one example of the general category of non-ferrous metal with which this invention may be used.

Although the presently preferred embodiment of this invention has been described, it will be understood that within the purview of the invention various changes may be made within the scope of the following claims.

Having thus described our invention, we claim:

1. A valve assembly for use in a low pressure casting apparatus, said valve assembly comprising:

an elongate housing having a longitudinally-extending through bore;

a valve body assembly spanning said through bore and comprising a valve plate made from a non-wetting ceramic material and having a valve port centered about a vertical axis;

a valve closure member made from a non-wetting ceramic material and axially movable along said vertical axis to open and close said port;

and a valve drive mechanism for moving said valve closure member along said axis.

2. The valve assembly of claim 1 wherein both said valve plate and said valve closure member are made from aluminum titanate.

3. The valve assembly of claim 1 wherein said valve body assembly comprises a first support member spanning the bottom of said through bore, a second support member spaced from said first support member along the length of said through bore and spanning the top of said through bore, said valve plate being supported by said support members and spanning said through bore intermediate the top and bottom of said through bore.

4. The valve assembly of claim 3 wherein said support members each comprise a matrix of refractory material and wherein said valve plate has leading and trailing edges embedded, respectively, in said first and said second support members.

5. An interchangeable valve assembly for use in a low pressure casting apparatus having a launder system, comprising:

a casing detachably connectable to mating parts of said launder system so that said valve assembly may be readily removed from said launder system as a unitary structure for repair or replacement;

a valve mounted in said casing and having:

a valve body comprising a valve housing formed from a matrix of refractory material and a valve port element embedded in said valve housing, a molten metal passageway comprising an inlet conduit and an outlet conduit centered around a horizontal axis, and a valve closure member for closing said passageway comprising a valve plug extending into said valve body between said inlet conduit and said outlet conduit and having a through bore, said valve plug being rotatable about a vertical axis to open said valve passageway by aligning said through bore with said inlet conduit and said outlet conduit and said valve plug also being rotatable to position said through bore out of alignment with said conduits; and a valve operating mechanism mounted on said casing operable to selectively move said valve closure member between two positions, one in which said passageway is open and one in which said passageway is closed.

6. The valve assembly of claim 5 wherein said casing has upwardly and outwardly sloping end faces with apertured flanges for receiving mounting bolts for installation of said valve assembly into said launder assembly.

7. The valve assembly of claim 5 wherein said valve operating mechanism comprises a drive shaft connected to said valve plug and extending upwardly therefrom, an air actuator, and a linkage assembly connected between said drive shaft and said air actuator for rotating said valve plug.

8. The valve assembly of claim 7 further comprising spring means biasing said drive shaft and thereby said valve plug downward.

9. The valve assembly of claim 5 wherein said valve plug has upper and lower portions, is generally circular in cross-section, and wherein the upper portion is larger in diameter than the lower portion.

10. The valve assembly of claim 5 wherein said valve body and said valve closure member are made from graphite.

11. The valve assembly of claim 5 further comprising an inlet in said casing for introducing a gas under pressure into said casing above said valve closure member.

12. An interchangeable valve assembly for use in a low pressure casting apparatus having a launder assembly, comprising:

a casing detachably connectable to mating parts of said launder assembly so that said valve assembly may be readily removed from said launder assembly as a unitary structure for repair or replacement, said casing having a molten metal conduit through which molten metal may flow;

a valve mounted in said casing including:

a valve plate having a valve port therein centered about a vertical axis, said valve plate partially impeding said flow of molten metal so that molten metal in said conduit flows only through said valve port, and a valve closure member axially movable along said vertical axis; and a valve operating mechanism mounted on said casing operable to selectively move said valve closure member between two positions, one in which said port is open and one in which said port is closed, said flow of molten metal being completely impeded when said valve closure member is in said closed position.

13. The valve assembly of claim 12 wherein said casing has upwardly and outwardly sloping end faces with apertured flanges for receiving mounting bolts for installation of said valve assembly into said launder assembly.

14. The valve assembly of claim 12 wherein said valve operating mechanism comprises an air actuator connected to said valve plug.

15. The valve assembly of claim 12 wherein said valve plate and said valve closure member are made from non-wetting ceramic material.

16. The valve assembly of claim 15 wherein said non-wetting ceramic material is aluminum titanate.

17. The valve assembly of claim 12 wherein said valve port has a circular wall in the shape of a truncated cone and said valve closure member has the shape of a truncated cone.

18. A valve assembly for use in a low pressure casting apparatus, said valve assembly comprising:

a valve support;

a valve body mounted on said support comprising a valve housing formed from a matrix of refractory material and a valve port element embedded in said valve housing, said port element having a port with an inlet end and an outlet end;

said valve housing having a longitudinally-extending inlet conduit open to said inlet end of said port and a longitudinally-extending outlet conduit opening to said outlet end of said port;

a valve plug having a through bore, said valve plug being rotatable between two positions, one position in which said through bore is aligned with said port and a second position in which said through bore is completely non-aligned with said port; and a drive mechanism connected to said valve plug that rotates said valve plug between said two positions.

19. The valve assembly of claim 18 wherein said valve port element and said valve plug are made from graphite.

20. The valve assembly of claim 18 wherein said valve support has sides and a bottom lined on the inside thereof with high temperature insulating material and said matrix of refractory material is backed by said insulating material.

21. The valve assembly of claim 20 wherein said valve port element is made from a machinable, non-wetting material capable of withstanding the temperatures of molten aluminum.

22. The valve assembly of claim 21 wherein said valve port element is made from graphite.

23. The valve assembly of claim 20 wherein said valve plug is made from a machinable, non-wetting material capable of withstanding the temperatures of molten aluminum.

24. The valve assembly of claim 23 wherein said valve port element is made from graphite.

25. The valve assembly of claim 20 wherein said insulating material comprises high temperature insulating blocks.

26. The valve assembly of claim 18 wherein said valve port element is made from a machinable, non-wetting material capable of withstanding the temperatures of molten aluminum.

27. The valve assembly of claim 26 wherein said valve port element is made from graphite.

28. The valve assembly of claim 26 wherein said valve plug is made from a machinable, non-wetting material capable of withstanding the temperatures of molten aluminum.

29. The valve assembly of claim 28 wherein said valve plug is made from graphite.

30. The valve assembly of claim 18 wherein said valve plug is made from a machinable, non-wetting material capable of withstanding the temperatures of molten aluminum.

31. The valve assembly of claim 30 wherein said valve plug is made from graphite.

32. A valve assembly for use in a low pressure casting apparatus, said valve assembly comprising:

a valve support comprising:

a metal casing which is U-shaped in transverse cross section, apertured mounting flanges extending along the top and both ends of said casing, and a cradle of high temperature insulating refractory material extending along the inside bottom and sidewalls of said metal casing;

a valve body mounted on said cradle and comprising:

an elongate, generally rectangular valve housing comprising a matrix of castable refractory material;

a spool-shaped valve port element embedded in said valve housing, said valve port element comprising a cylindrical center section, an upper head section and a lower base section, said sections being coaxial about a vertical axis, said head section and said base section being generally cylindrical and having a larger diameter than said center section, a vertical valve plug cavity in said valve port element having a generally conical inner wall, said valve plug cavity being defined in part by wall portions formed by said center section which have an inlet bore section opening to said cavity and an outlet bore section opening to said cavity, said bore sections being diametrically-extending and mutually-coaxially oriented on a horizontal axis, said valve housing having a longitudinally-extending inlet conduit open to said inlet bore section and a longitudinally-extending outlet conduit opening to said outlet bore section, and a valve plug made in the form of a truncated cone rotatably mounted in said valve plug cavity, said plug having a horizontal through bore which, upon rotation of said plug, can be aligned selectively with said inlet bore section and said outlet bore section or completely out of alignment with said inlet bore section and said outlet bore section, said valve plug further comprising a driven coupling at the upper end thereof;

a valve operating mechanism comprising a vertical drive shaft connected to said valve plug and a drive mechanism that rotates said drive shaft about its longitudinal axis and thereby also rotates said valve plug; and a cover assembly comprising an inverted box-like rectangular casing lined with insulating material mounted on the upper flanges of said valve support and overlying a portion of said valve support and said valve body, a cavity in said cover assembly overlying said drive coupling, said drive transmission coupling and said driven coupling, and a bore extending through the top of said cover assembly through which said drive shaft extends.

33. The valve assembly of claim 32 further comprising bearing means for confining said drive shaft and thereby said valve plug for rotation about a vertical axis.

34. The valve assembly of claim 33 wherein said bearing means comprises a mutually spaced pair of bearings.

35. The valve assembly of claim 32 further comprising spring means biasing said drive shaft and thereby said valve plug downwardly.

36. The valve assembly of claim 32 further comprising means for introducing a gas under pressure into said cavity in said cover member.

37. The valve assembly of claim 32 wherein said valve port element and said valve plug are made from graphite.

* * * * *